United States Patent [19]

Legbandt

[11] 4,161,564

[45] Jul. 17, 1979

[54] COATING FORMULATION, METHOD, AND COATED SUBSTRATE

[75] Inventor: Thomas J. Legbandt, Long Beach, Calif.

[73] Assignee: La Barge, Inc., St. Louis, Mo.

[21] Appl. No.: 772,854

[22] Filed: Feb. 28, 1977

Related U.S. Application Data

[62] Division of Ser. No. 612,292, Sep. 11, 1975, abandoned.

[51] Int. Cl.[2] ..... H01B 7/18; H01B 7/20

[52] U.S. Cl. ..... 428/381; 174/102 C; 174/120 SC; 428/383; 428/384

[58] Field of Search ..... 427/118; 428/377, 378, 428/381, 383, 384; 260/858, 49; 174/120 SC, 102 C; 361/318, 319

[56] References Cited

U.S. PATENT DOCUMENTS

| | | | |
|---|---|---|---|
| 242,813 | 6/1881 | Chinnock | 174/102 SC |
| T889,010 | 8/1971 | Tapley | 361/319 |
| 1,277,248 | 5/1883 | Edgerton | 174/102 SC |
| 2,211,584 | 8/1940 | Ruden | 174/102 SC |
| 2,939,904 | 6/1960 | Ingmanson | 427/118 |
| 3,259,688 | 7/1966 | Towne | 427/118 |
| 3,333,049 | 7/1967 | Humphrey | 427/118 |
| 3,461,219 | 8/1969 | Endacott | 427/118 |
| 3,609,113 | 9/1971 | Schade | 260/30.2 |
| 3,661,859 | 5/1972 | Patton | 250/77.5 CH |
| 3,684,821 | 8/1972 | Miyauchi | 174/102 SC |
| 3,734,896 | 5/1973 | Patton | 260/77.5 AM |
| 3,922,465 | 11/1975 | Kawaguchi | 427/118 |
| 4,008,205 | 2/1977 | Jones | 260/49 |

FOREIGN PATENT DOCUMENTS

| | | | |
|---|---|---|---|
| 947390 | 5/1974 | Canada | 174/102 SC |

*Primary Examiner*—Michael F. Esposito
*Attorney, Agent, or Firm*—Koenig, Senniger, Powers and Leavitt

[57] ABSTRACT

A formulation which may be applied to a substrate to produce a flexible, high temperature, thermally stable and color stable film thereon. The formulation comprises a poly(1,3-imidazolidine-2,4,5-trione) polymer, a free radical scavenger in an amount sufficient to inhibit cleavage and cross-linking of the polymer by action of oxygen thereon, and a solvent for the polymer. Also disclosed are a method for applying a flexible, high temperature, thermally stable and color stable color coating to a polyimide substrate; the substrate so coated; and an insulated conductor assembly having a polyimide insulative cover and an imidazolidine trione based-top-coating over the cover.

4 Claims, 2 Drawing Figures

COATING FORMULATION, METHOD, AND COATED SUBSTRATE

This is a division, of application Ser. No. 612,292, filed Sept. 11, 1975 now abandoned.

BACKGROUND OF THE INVENTION

This invention relates to the field of organic olymeric coatings and, more particularly, to formulations and methods for applying a flexible, high temperature, thermally stable and color stable coating to a substrate such as a polyimide insulative cover for a metal conductor.

Polyimide materials such as that sold under the trade designation "Kapton" by E. I. DuPont have both favorable dielectric properties and high temperature thermal stability which render them uniquely suited for use as insulative materials for electrical conductors. Because of their resistance to oxidation and their retention of flexibility, even after long-term exposure to elevated temperatures, the polyimides have found particular application as conductor insulative material in high performance services such as, for example, aircraft and spacecraft.

Typically, metal conductors are provided with an insulative cover of polyimide by helically wrapping a polyimide tape around the conductor, with successive wraps of the tape partially overlapping each other. Commercially available polyimide tape is commonly provided with fluorinated ethylene propylene resin (FEP) backing on one or both sides. After the conductor has been wrapped with the tape, the resulting assemblage is heated to a temperature at which the FEP fuses to bond together the overlapping wraps of the tape.

Both stranded cable and single conductor wire insulated with polyimide as described above have proven to be highly serviceable in high temperature oxidative environments which are relatively destructive of other forms of insulation. Because of the deep amber color of polyimide films, however, the utility of this type of insulation is somewhat limited where there is a need for an opacified or pigmented insulation, in particular where color coding of the wire insulation is essential. For example, it has been found to be very difficult to obtain a good opaque white color by addition of white pigment to the film since the amount of pigment necessary to overcome the intense amber of the film adversely affects other properties of the insulated wire, rendering it incapable of meeting government specifications for high performance applications such as in aircraft and spacecraft. The alternative approach of utilizing a topcoating to color the insulated wire has also met with little success since most topcoating materials adversely affect the properties of the underlying polyimide or, themselves, are not capable of maintaining their stability and flexibility under the severe service conditions in which polyimide insulated conductors are used.

To be suitable for color coding of a polyimide insulation, a topcoating material must be initially flexible and resistant to embrittlement when exposed to high temperatures over long periods of time. Further, of course, the composition must retain color stability when exposed to such adverse environments. Additionally, the coating material must be adherent to the substrate and capable of masking the intense amber color of the underlying polyimide so as to provide and maintain a distinctive coloration, preferably of a pastel hue.

SUMMARY OF THE INVENTION

Among the several objects of the present invention, therefore, are the provision of a coating formulation adapted for application to substrates such as polyimide; the provision of such formulations which are pigmented and afford a distinctive color stable topcoating over an amber polyimide substrate; the provision of such formulations which have a relatively high elongation and retain their flexibility even when exposed to elevated temperatures over extended periods of time; the provision of such formulations which are useful for the color coding of polyimide insulated conductors; the provision of such formulations which provide a topcoating that is firmly adherent to a polyimide substrate; the provision of methods for applying a flexible, high temperature, thermally stable and color stable color coating to a polyimide substrate; and the provision of a color coded insulated conductor assembly. Other objects and features will be in part apparent and in part pointed out hereinafter.

In one of its aspects, therefore, the present invention is directed to a formulation which may be applied to a substrate to produce a flexible, high temperature, thermally stable and color stable film thereon. The formulation includes a poly(1,3-imidazolidine-2,4,5-trione) polymer, a free radical scavenger in an amount sufficient to inhibit cleavage and cross-linking of said polymer by action of oxygen thereon, and a solvent for the polymer.

More particularly, the present invention is directed to such a formulation which further contains a polyarylether sulfone in a proportion of between about 1% and about 6% by weight based on the amount of the poly(1,3-imidazolidine-2,4,5-trione) present, the imidazolidine polymer has the formula:

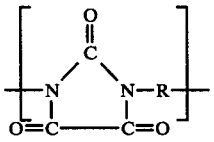

where R is an organic moiety selected from the group consisting of aliphatic, alicyclic, aromatic and mixtures thereof, and the formulation has a viscosity of at least 60 cps-sec.

The invention is further directed to a method for applying a flexible, high temperature, thermally stable and color stable color coating to a polyimide substrate. In this method, the substrate is contacted with a formulation comprising the aforesaid imidazolidine trione polymer, a free radical scavenger in an amount sufficient to inhibit cleavage and cross-linking of the polymer by the action of oxygen thereon, a coloring agent compatible with the imidazolidine polymer, and a solvent for the polymer. The solvent is removed from the resultant wet coating to provide a dry color coating.

The invention is further directed to a composite film comprising a polyimide substrate and having thereover a color coating comprising the aforesaid imidazolidine trione polymer, a free radical scavenger in a proportion sufficient to inhibit cleavage and cross-linking of the polymer by the action of oxygen thereon, and a coloring agent compatible with the polymer.

The invention is additionally directed to an insulated conductor assembly. This assembly comprises a conductor having a polyimide insulative cover surrounding it. Over the cover is a color coating comprising the aforesaid imidazolidine trione polymer and a free radical scavenger in a proportion sufficient to inhibit cleavage and cross-linking of the polymer by action of oxygen thereon.

BRIEF DESCRIPTION OF THE DRAWING

Corresponding reference characters indicate corresponding parts throughout the drawing.

DESCRIPTION OF THE PREFERRED EMBODIMENTS

Figure 1:
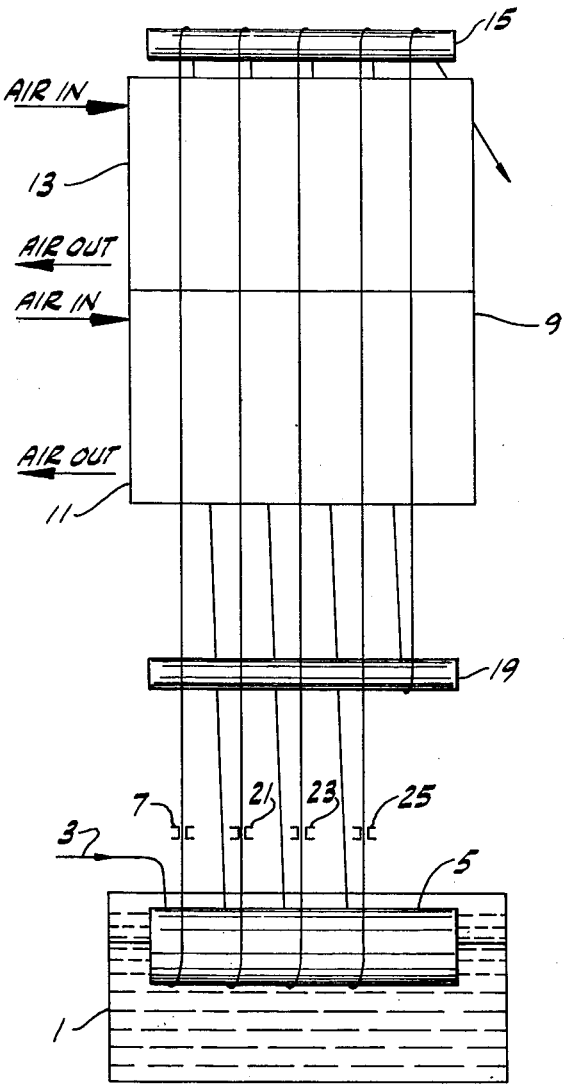
FIG. 1 is a schematic front elevation illustrating an equipment arrangement which may be utilized to carry out the method of the invention.
Figure 2:
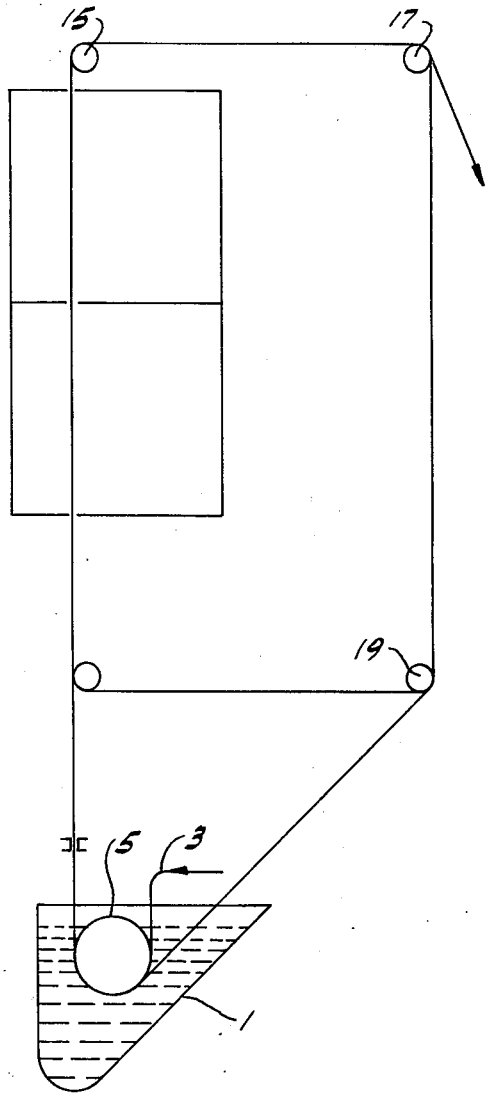
FIG. 2 is a schematic side elevation of the apparatus of FIG. 1.

In accordance with the present invention, a novel formulation has been discovered which is highly effective as an electrically insulative coating material. Comprised of a poly(1,3-imidazolidine-2,4,5-trione) polymer and optionally containing a pigment or soluble organic dye, the formulation is uniquely adapted for color coding a polyimide-wrapped conductor. It has been found that poly(1,3-imidazolidine-2,4,5-trione) polymers, whose manufacture is described in U.S. Pat. No. 3,661,859, are compatible with various opacifiers, colored pigments and soluble dyes to provide a full range of color coatings which fully mask the amber color of a polyimide. Mixtures of the imidazolidine-2,4,5-trione polymers and coloring agents, containing a sufficient proportion of coloring agent and opacifier to fully mask the amber color of the underlying polyimide, are adherent to a polyimide substrate and possess a degree of elongation adequate to resist cracking when the mixture is used as a topcoating on a polyimide insulated conductor. Moreover, such a topcoating is thermally stable and resists embrittlement and cracking even when exposed to elevated temperatures for extended periods of time. Of equal significance, the topcoating retains color stability under such severe environmental conditions.

The essential components of the formulation of the invention are the poly(1,3-imidazolidine-2,4,5-trione) polymer, a free radical scavenger for protecting the polymer chain from cross-linking and cleavage, and a solvent for the polymer.

Poly(1,3-imidazolidine-2,4,5-trione) polymers useful in the present invention are comprised of the recurring unit:

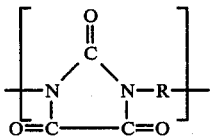

where R is an aliphatic, alicyclic or aromatic organic moiety. As described in U.S. Pat. No. 3,661,859 (incorporated herein by reference), such polymers are produced by hydrolysis of precursor polymers of the imino imidazolidine dione type whose synthesis from the reaction of a diisocyanate with hydrogen cyanide is described in U.S. Pat. Nos. 3,547,897 and 3,591,562. Since a mixture of diisocyanates may be utilized in the preparation of the precursor polymers, the R groups contained in the poly(1,3-imidazolidine-2,4,5-trione) may be a mixture of aliphatic, alicyclic and/or aromatic moieties.

Preferably, the R group is an alkylene group such as hexamethylene or an aromatic of the following types:

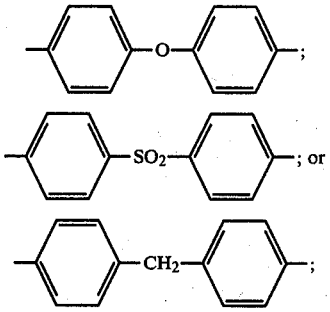

as derived from diphenylether-4,4'-diisocyanate, diphenylsulfone-4,4'diisocyanate, and diphenylmethane-4,4'-diisocyanate, respectively.

A particularly preferred poly(1,3-imidazolidine-2,4,5-trione) is that in which R is

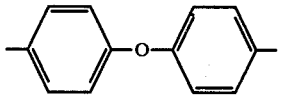

as sold under the trade designation "PPA-E" by Exxon Corporation. The commercial product has a glass transition temperature of 577° F., a specific gravity of 1.38, a refractive index of 1.64, and an intrinsic viscosity in dimethylformamide of approximately 0.9. This polymer is particularly preferred since it has a low susceptibility to cross-linking and the ether bond renders it highly resistant to cleavage of the polymer chain. Thus, this polymer possesses exceptional thermal stability and maintains both its mechanical properties and resistance to discoloration even when exposed to severe time/temperature conditions.

Another highly suitable and commercially available poly(1,3-imidazolidine-2,4,5-trione) is that sold by Exxon Corporation under the trade designation "PPA-M," wherein R is a hexamethylene group. Because of the labile hydrogens on the hexamethylene chain, "PPA-M" is somewhat more susceptible than "PPA-E" to oxidation, cleavage and cross-linking at high temperatures but, nonetheless, performs very effectively in a topcoating for polyimide where conditions are relatively severe. The commercial product has a glass transition temperature of 554° F., a specific gravity of 1.3, a refractive index of 1.65 and an intrinsic viscosity in dimethylformamide of about 0.9.

Where the poly(1,3-imidazolidine-2,4,5-trione) polymer contains a significant number of diphenylsulfone linkages, the adhesion of a topcoating to a polyimide substrate is particularly effective. The use of an imidazolidine trione polymer of this type obviates the need for enhancing adhesion by the additional inclusion in the formulation of a poly(arylether sulfone), which is otherwise preferred.

Although the concentration of the poly(1,3-imidazolidine-2,4,5-trione) polymer in the formulation of the invention is not highly critical, it is preferred that the formulation have a Brookfield viscosity of at least about 60 cps-sec. at 60 rpm and 25° C., using a No. 2 spindle. To provide such a viscosity, it is normally necessary for the imidazolidine trione polymer content of the formulation to be at least about 5% by weight. Such a minimum proportion is also desirable in order to provide adequate coating thicknesses and minimize drying time. Preferably, the polymer content of the formulation is on the order of 15% by weight and higher proportions may be desirable where especially thick coatings are contemplated, for example in printing applications as referred to hereinbelow.

The presence of a free radical scavenger is essential in order to maintain the desired properties of a poly(1,3-imidazolidine-2,4,5-trione)-based coating on a substrate in a high temperature environment. When exposed to high temperature or u.v. light for extended periods of time, the aliphatic, alicyclic or aromatic linkages are subject to attack by oxygen to produce peroxides through which cross-linking can occur with consequent embrittlement. Cleavage of the polymer chain may also be suffered at the point where oxygen attack occurs. The free radical scavenger inhibits chain cleavage or cross-linking by capturing the free radicals released on oxidation or irradiation to produce species which either have energy levels too low for further reaction or which decompose into stable products. Any free radical scavenger which is compatible with the poly(1,3,-imidazolidine-2,4,5-trione) polymer and soluble in the formulation solvent may be utilized. A number of such scavengers are undesirable for use in a color coating formulation, however, because they themselves are highly colored. One particularly useful free radical scavenger is the 3,5-t-butyl-4-hydroxyhydrocinnamic acid triester with 1,3-tris (2-hydroxyethyl)-s-triazine-2,4,5-(1 H,3 H,5 H)-trione as sold by B. F. Goodrich under the trade designation "Good-rite 3125". Other useful scavengers include triphenyl silane coupled to boron and benzimidazole compounds. The proportion of the free radical scavenger in the formulation should be sufficient to prevent significant cross-linking or chain cleavage in the coating laid down from the formulation when that coating is exposed to a high temperature environment. Typically, the formulation of the invention includes between about 0.1% and about 2% by weight of the free radical scavenger based on the poly(1,3-imidazolidine-2,4,5-trione) polymer content, with a proportion of approximately 0.25% being preferred.

A variety of relatively high boiling solvents are suitable for use as the vehicle in the formulation of the invention. Poly(1,3-imidazolidine-2,4,5-trione) polymers are generally soluble in solvents such as dimethylformamide, N,N-dimethylacetamide, dimethylsulfoxide and N-methyl-2-pyrrolidone. Where R is an alkylene group such as the hexamethylene group of "PPA-M", the polymer is also typically soluble in solvents such as γ-butyrolactone, cyclohexanone, cyclopentanone and dioxolane.

Except in certain instances where R in the poly(1,3-imidazolidine-2,4,5-trione) polymer is a diphenylene sulfone group, it is strongly preferred that the formulation of the invention further include a poly(arylether sulfone). The poly(arylether sulfone) serves in part as an extender which may be used to significantly reduce the cost of preparing and applying the formulation of the invention. The poly(1,3-imidazolidine-2,4,5- trione) polymers are relatively expensive but it has been found that mixtures of these polymers with a poly(arylether sulfone) provide highly satisfactory coating materials of considerably reduced cost. The poly(arylether sulfone), however, affords several other important advantages, including plasticizing the coating deposited from the formulation and thus improving its flexing properties after exposure to high temperatures. The presence of the poly(arylether sulfone) further significantly improves the adhesion of an imidazolidine-trione-based coating formulation to a polyimide substrate. Additionally, the poly(arylether sulfone) cooperates with the free radical scavenger in inhibiting cleavage and cross-linking of the imidazlidine trione polymer. The sulfone group is believed to react with perioxides formed on initial oxygen attack of a hexamethylene group, for example, to yield a deactivated species which resists further reaction of the type which may lead to cross-linking or cleavage. Preferably, the poly(arylether sulfone) is present in the coating formulation in a proportion of between about 1% and about 6% by weight based on the amount of the imidazolidine trione polymer present.

A variety of calcined inorganic pigments and temperature stable soluble organic dyes may be used as coloring agents where the formulation of the invention is used to apply a color coding. To achieve maximum opacity, inorganic pigments used in the formulation should have a particle size of 1μor less, preferably about 0.6–0.8μ. Typically useful pigments include the Co/Ti blue pigments sold under the trade designation "V-3285" by Ferro Corp. and those sold under the trade designations "Blue 177" and "Blue 17" by Shepherd Chemical Co. The use of organic coloring agents containing active divalent metals should be carefully avoided because such divalent metals can initiate rapid cross-linking of, and are thus not compatible with, the imidazolidine-2,4,5-trione polymers. Depending on the depth of color desired, the calcined pigment content of the formulation of the invention may range from 20%–45% by weight based on the amount of imidazolidine trione polymer present. Effective coloration is achieved with much lower proportions of soluble organic dyes.

Where the formulation is colored with a translucent organic pigment or soluble dye and is utilized to apply a color coating to an intensely colored substrate such as polyimide, it should also contain titanium dioxide pigment as an opacifier in order to fully mask the underlying color effect. Where the formulation contains a calcined pigment and is used for color coding polyimide-wrapped conductors, the proportions of such pigment and $TiO_2$ may be adjusted to provide an appealing yet clearly distinguishable pastel hue.

Titanium dioxide acts not only as a pigment and opacifier, but also as a reflectance enhancer. Other reflectance enhancers having a sufficiently high refractive index on the order of 1.9 or greater can also be advantageously employed in the formulation of the invention. A particularly effective reflectance enhancer is glass beads. Other reflectance enhancers include particulate aluminum and particulate aluminum oxide. Where a reflectance enhancer is used, the sum of proportions of pigment and reflectance enhancer should not exceed about 45% by weight and may typically range between about 20% and about 45% by weight based on the amount of imidazolidine trione polymer present.

In order to improve the wettability of the formulation on a polyimide substrate or other substrate, a surfactant effective for such purpose is also preferably included in the coating formulation. The surfactant should be present in a proportion sufficient to impart to the formulation a surface tension of not greater than about 35 dynes/cm$^2$. Most preferably, the surfactant used is volatilizable, i.e., capable of being essentially completely driven off at temperatures of 375° F. or below. Exemplary surfactant materials include terpenes and relatively high boiling ketones. These materials are effective not only in directly lowering the surface tension of the formulation, but further serve to inhibit moisture absorption which otherwise tends to increase the surface tension of hygroscopic solvents such as N-methyl-2-pyrrolidone. Addition to the coating formulation of 2%–4% by weight of a mixture of α-terpenes and high boiling ketones imparts the desired surface tension.

To prevent undesirable cascading of the coating formulation on a substrate to which it has been applied, for example, the polyimide insulative cover on a conductor, a thixotropic agent is preferably incorporated in the formulation. A suitable thixotropic agent is comprised of a mixture of a polycarboxylic acid compatible with the imidazolidine trione polymer, e.g., the polycarboxylic acid sold under the trade designation "Carbopol 934" by B. F. Goodrich Company, and a volatilizable disecondary amine such as 2,2,'-diethyldihexylamine. A polycarboxylic acid is considered compatible with the polymer if it is soluble in both the polymer and the formulation solvent. In order to avoid excessive cross-linking under service conditions, it is particularly important that the secondary amine component be essentially completely removable by volatilization. Addition of approximately 0.1% by weight "Carbopol 934" and approximately 0.1% by weight of 2,2'-diethyldihexylamine provides the desired thixotropic properties.

In accordance with the method of the invention, a flexible, high temperature, thermally stable and color stable color coating is applied to a polyimide substrate. The formulation utilized in the method of the invention includes a poly(1,3-imidazolidine-2,4,5-trione) polymer, a free radical scavenger, a coloring agent and a solvent, all of the type described above, and, preferably, in the proportions discussed above. The polyimide substrate is contacted with the formulation in any suitable manner. In the case of the color coding of a polyimide-covered conductor, this is most conveniently accomplished by simply dipping the wrapped conductor in the coating formulation, preferably by continuously running the covered conductor through the formulation. A wet coating is thus provided which is subsequently dried to remove solvent and provide a dry color topcoating on the substrate.

The thickness of the topcoating may be built up to a predetermined level by repeated application of the formulation to the substrate, for example, by repeatedly running a polyimide-wrapped conductor through a bath comprising the formulation. The solvent is removed between successive applications of the formulation to provide a dried base upon which a further thickness of coating can be built. After the final pass through the formulation bath, the solvent is again removed and a coating of the desired thickness is obtained.

Polyimide tape used for insulation of conductors is typically provided with fluorinated ethylene propylene resin (FEP) backing which is outwardly oriented as the tape is wrapped around the conductor. Thus, the overlapping area defined by two successive winds of the tape has an FEP sealant in between the wraps but the FEP is maintained out of contact with the conductor. Where the conductor is wrapped with FEP-backed tape in this manner, the external face of the insulative cover is almost entirely coated with FEP. If the formulation of the invention is to be applied over an insulative cover of this type, it is necessary to preliminarily apply an etchant such as 1,4-disodium naphthenate to the surface of the substrate to be coated in order to render it wettable by the formulation and bondable to the solid components of the coating formulation. Etching with 1,4-disodium naphthenate removes fluorine atoms from the FEP leaving from radicals, some of which are believed to coreact and degrade to a degree in the presence of water and u.v. light, to provide vinyl linkages, hydroxyl linkages and other active sites for bonding to the topcoating.

Where the surface to which the coating formulation is directly applied to either bare polyimide film or a polyimide wire enamel of the type sold under the trade designation "Liquid H 301" by E. I. DuPont de Nemours and Company, no etching treatment is necessary.

Application of the colored formulation of the invention to a polyimide such as polyimide insulative film provides a composite film comprising the polyimide substrate and having thereover a dry color topcoating. After drying, the topcoating includes the poly(1,3-imidazolidine-2,4,5-trione) polymer, the free radical scavenger, and the coloring agent, and, preferably, further contains a poly(arylether sulfone). Where the polyimide substrate of this composite film is the insulative cover surrounding an electrical conductor, a novel color coded insulative conductor assembly is provided.

Although developed for the primary purpose of applying a color coded topcoating over polyimide insulated conductors, the formulation of the invention may also be applied to other plastic substrates, for example, polyethylene terephthalate. Additionally, the formulation may be directly applied as an insulating material over a solid conductor. Tests conducted on the insulating material applied in this manner have indicated a dielectric breakdown strength in excess of 900 v/mil (0.001 in.) Moreover, the formulation of the invention exhibits excellent adhesion to substrate such as high carbon steel, stainless steel alloys, high nickel steel or copper.

Where prepared with a high solids content, the formulation may also serve as a printing ink for applying lettering or other designations to the external surface of polyimide. This formulation may further find application as an adhesive laminate used in a manner similar to FEP Teflon for bonding together overlapping layers of a helically wound polyimide insulative wrapping.

Coatings prepared from the formulation of the invention can be rendered conductive by the incorporation of microfine particles of aluminum, carbon black or silver in the formulation. Such coatings applied over an insulated conductor serve as an electromagnetic shield and may also prepare the surface for electroplating with copper or other highly conductive metal to provide an exceptionally low weight coaxial type shielded wire construction.

The following examples illustrate the invention:

EXAMPLE 1

A 24-gauge conductor consisting of 19 stranded 36-gauge nickel plated alloy 135 copper wires was provided with a two-ply counter-wrapped cover of FEP-backed Kapton polyimide tap, and the wrapped tape dried and heat-sealed. After drying, the taped wrapping was etched in a solution of 1,4-disodium naphthenate, rinsed with a mixture of actone and methyl alcohol, dried for 24 hrs., and then provided with an overcoating comprising a liquid polyimide enamel sold under the trade designation "Liquid H 301" by E. I. DuPont de Nemours and Company in which a white pigment was dispersed.

Using the apparatus shown in the drawings, the wrapped, heat-sealed and overcoated conductor was provided with a color coded topcoat. To prepare the topcoat formulation, a mixture was initially prepared consisting of the poly(1,3-imidazolidine-2,4,5-trione) polymer sold undr the trade designation "PPA-M" by Exxon Corporation (70 g), the poly(arylether sulfone) sold under the trade designation "PES 720 P" by Imperial Chemical Industries (3.5 g), the free radical scavenger sold under the trade designation "Goodrite 3125" by B. F. Goodrich and Company (184 mg), and dimethylformamide (513.3 ml). To the resulting solution, two pigment dispersions were added with vigorous stirring. One pigment component comprised a 20% w/v $TiO_2$ dispersion in N-methyl-2-pyrrolidone (136.4 g) and the other comprised a 10% w/v dispersion of the red-/orange pigment sold under the trade designation "9879" by Ciba-Geigy Corporation in N-methyl-2-pyrrolidone (26.9 g). The resultant pigment load factor was 33.4% based on the resins solids present.

Referring to the drawings, shown at 1 is a stainless steel trough containing the above-described coating formulation at room temperature. The polyimide-wrapped conductor 3 was passed into the bath at a linear speed of 15 ft/min and trained around the lower side of idler roller 5 in a circumferential groove in the roller. As shown in the drawings, roller 5 was almost completely submerged in the bath. On leaving the bath after passing under roller 5, conductor 3 passed vertically upward through metering dies 7 and into the bottom end of two-stage vertical drying oven 9.

Drying oven 9 included two 5-ft high sections 11 and 13 disposed one above the other. Bottom section 11 was maintained at a temperature of about 275° F. By air passed into the section near its top and withdrawn near its bottom. Similarly, top section 13 was maintained at a temperature of about 325°-350° F. by air introducted at its top and withdrawn at its bottom end. Air withdrawn from each oven section was moved through an external reheating loop by a blower (not shown in the drawing). Wrapped conductor 3 was passed vertically up through both sections of the oven and out the top of section 13. By the time the conductor passed out the top of the oven, the solvent had been completely removed and the first application of the coating formulation completely dried.

After leaving oven 9, conductor 3 was returned to the coating bath by passage over grooved rollers 15, 17 and 19. Again submerged in the bath, the wrapped conductor was trained around a second groove in roller 5 spaced longitudinally of the roller from the groove around which the first pass was trained. Leaving the bath on the second pass, the conductor was drawn through metering dies 21 and back into oven 11. In similar fashion, the conductor was subjected to two additional passes through the coating formulation bath and three more passes through the oven, being drawn through metering dies 23 and 25 on the third and fourth passes, respectively. The wrapped conductor leaving the final pass through the oven had a flexible opaque pink pastel hued topcoating of a thickness of about 1 mil, which fully masked the underlying amber color of the polyimide.

The color coded conductor was subjected to a heat-aging test at a temperature of 260° C. for 24 hrs. After exposure to these environmental conditions, the color coded conductor was subjected to a mandrel bend test in which it was wrapped around itself (0.037 in. average OD). No visible cracking was observed in the portion of the wire bent on this radius. After exposure at 260° C. for 24 hrs., the topcoating darkened slightly but the color remained clearly discernible.

Another specimen of the color coded conductor was heat-aged at 220° C. for 96 hrs. This specimen also resisted visible cracking when subjected to a mandrel bend test by being wrapped around itself.

Another specimen of the coated wire was subjected to a cold bend test by wrapping it around a 0.250 in. diameter mandrel at −65° C. Again, no visible cracks were observed.

Another specimen of the coated conductor was cycled several times between −65° C. and 220° C. Subjected to a mandrel bend test in which it was wrapped around itself, this specimen also exhibited no visible cracks.

A further specimen of the coated conductor of this example was subjected to a standard General Electric scrape abrader test in which a round hardened steel needle loaded at 450 g was drawn along the surface of the topcoat. The portion of the topcoat surface subjected to this test experienced no chipping or delamination after over 2000 cycles.

EXAMPLE 2

Using the formulation and method generally described in Example 1, a coating formulation was prepared having the following composition:

| | | |
|---|---|---|
| PPA-M | 100 | g |
| PES 720 P | 5 | g |
| Dimethylformamide | 400 | g |
| Goodrite 3125 | 0.262 | g |
| 20% w/v $TiO_2$ in N-methyl-2-pyrrolidone | 130 | g |
| Blue dye sold under the trade designation "Oil Blue ZV" by American Cyanamid Co. | 2.58 | g |

A 10 mil/diameter phosphate coated hardened spring steel wire was coated by two passes through the formulation of this example. On leaving the coating formulation bath on the first pass, the wet-coated wire passed through a silicone rubber die having a 0.015-in. opening resting on the formulation meniscus. On the second pass, the wet-coated wire passed through a similar die having a 0.01625-in. opening. The rate of passage through the formulation and dies was 4 ft/min. and the wet coating was dried at a temperature of 250° F. for 1 min. after each pass through the coating formulation and the dies.

The coated wire of this example was bent around a ⅛ in. mandrel with no visible cracking of the coating, and survived over 100 scrapes with a General Electric scrape abrader loaded at 150 g, with no electrical shorting. The coated wire further resisted a 500 v d.c. high pot test for more than 1000 hrs. in water containing 0.5% of a wetting agent sold under the trade designation "Aerosol OT" by American Cyanamid Co.

EXAMPLE 3

A 16-gauge conductor consisting of 19 strands of 29-gauge nickel plated soft copper wire was provided with two counter-helical wrappings of an FEP Teflon-backed Kapton polyimide tape. The wrapped conductor was not coated with a liquid polyimide overcoat but was directly coated in the manner described in Example 1 using a formulation having the following composition:

| | | |
|---|---|---|
| PPA-M | 1939 | g |
| PES 720 P | 77.5 | g |
| A surfactant comprising a mixture of α-terpenes and high boiling ketones sold under the trade designation Byketol-OK by Byk-Mallinkrodt | 478 | g |
| Goodrite 3125 | 5.13 | g |
| N-methyl-2-pyrrolidone | 12942 | g |
| 20% w/v $TiO_2$ dispersion in N-methyl-2-pyrrolidone | 3641 | g |
| 10% w/v dispersion of a blue pigment sold under the trade designation BT 449 D by E. I. DuPont de Nemours and Company in N-methyl-2-pyrrolidone | 226 | g |

An average coating thickness of greater than 1 mil was obtained.

The coated conductor was wrapped around a mandrel having a diameter of three times the OD of the coated conductor (67 mils) with no visible cracking in the topcoat.

EXAMPLE 4

A wrapped conductor of the type described in Example 3 was provided with a color coded imidazolidine trione-based topcoating in the manner described in Example 3. Over the color coated topcoating was applied "Liquid H 301" liquid polyimide containing 1% by weight based on the polyimide solids of dimethyoxydiphenyl silane. Antistick properties were thus imparted to the wrapped and color coded conductor, and a slight improvement was achieved in heat-aging before cracking.

EXAMPLE 5

A polyimide-wrapped conductor was prepared in the manner in Example 1 and then provided with a topcoating, again using the formulation, apparatus and method of Example 1 except that, in lieu of the pigments used in that formulation, the formulation of this example included:

| | | |
|---|---|---|
| 20% w/v dispersion of a powdered aluminum, sold under the trade designation No. 910 by United States Bronze Powders, Inc., in N-methyl-2-pyrrolidone | 138 | g |
| 20% w/v dispersion of graphite in N-methyl-2-pyrrolidone | 138 | g |

The topcoating obtained was sufficiently conductive for subsequent electroplating and a copper thickness of 0.003 in. was obtained by electroplating using conventional solutions and methods.

In view of the above, it will be seen that the several objects of the invention are achieved and other advantageous results attained.

As various changes could be made in the above methods and products without departing from the scope of the invention, it is intended that all matter contained in the above description or shown in the accompanying drawings shall be interpreted as illustrative and not in a limiting sense.

What is claimed is:

1. An insulated conductor assembly comprising a conductor, a polyimide insulative cover surrounding said conductor, and over said cover a color coding topcoating comprising a poly(1,3-imidazolidine-2,4,5-trione) polymer, a coloring agent compatible with said imidazolidine-trione polymer, and a free radical scavenger in a proportion sufficient to inhibit cleavage and cross-linking of said imidazolidine-trione polymer by action of oxygen thereon.

2. An assembly as set forth in claim 1 wherein said top coating further comprises a reflectance enhancing filler having a refractive index of at least about 1.9.

3. An assembly as set forth in claim 2 wherein said filler is selected from the group consisting of glass beads, particulate titanium dioxide, particulate aluminum and particulate aluminum dioxide.

4. An assembly as set forth in claim 1 wherein said top coating further comprises a poly(arylether sulfone).

* * * * *